United States Patent [19]

Seiderman

[11] 4,087,884

[45] May 9, 1978

[54] LATERAL EXTENSION BOWL ATTACHMENT DEVICE FOR ADAPTING STANDARD RELATIVELY HINGED TOILET SEAT AND COVER ASSEMBLIES FOR USE WITH NON-STANDARD BOWLS

[76] Inventor: Abe Seiderman, 7365 SW. 132 St., Miami, Fla. 33156

[21] Appl. No.: 765,083

[22] Filed: Feb. 3, 1977

[51] Int. Cl.[2] ..... E05D 7/04; E05D 11/00; A47K 13/12

[52] U.S. Cl. ..... 16/129; 16/128 R; 16/158; 4/236; 248/500

[58] Field of Search ..... 16/158, 150, 137, 148, 16/128–131; 248/500, 507, 25; 4/236, 240

[56] References Cited

U.S. PATENT DOCUMENTS

| | | | |
|---|---|---|---|
| Re. 28,035 | 6/1974 | Fork | 248/500 X |
| 3,254,363 | 6/1966 | Watson | 16/128 R |
| 3,551,922 | 1/1971 | Watson | 4/236X |
| 3,707,860 | 1/1973 | Singer et al. | 248/25 X |
| 3,754,300 | 8/1973 | Shepherd | 16/128 X |

FOREIGN PATENT DOCUMENTS

| | | | |
|---|---|---|---|
| 114,946 | 4/1942 | Australia | 4/236 |
| 559,445 | 8/1957 | Belgium | 16/128 R |
| 525,150 | 5/1931 | Germany | 16/129 |
| 944,261 | 12/1963 | United Kingdom | 4/236 |

*Primary Examiner*—James Kee Chi
*Attorney, Agent, or Firm*—Ernest H. Schmidt

[57] ABSTRACT

An elongated rectangular clamp member is provided in its underside with a transversely-extending recess for the clamping reception of an attachment hinge leaf of a toilet seat assembly, and a longitudinally extending channel for the reception of a bowl attachment screw having a head longitudinally-adjustably captured therein and adapted to be secured through toilet bowl hinge attachment holes, thereby being adjustable to attachment holes of various spacings.

7 Claims, 5 Drawing Figures

LATERAL EXTENSION BOWL ATTACHMENT DEVICE FOR ADAPTING STANDARD RELATIVELY HINGED TOILET SEAT AND COVER ASSEMBLIES FOR USE WITH NON-STANDARD BOWLS

This invention relates in general to toilet bowls, and is directed more particularly to auxiliary attachment means for adapting standard hinged toilet seat assemblies for use with non-standard toilet bowls wherein the distance between the openings for the hinge bolts is somewhat greater than that of standard bowls.

Because European and other foreign toilet bowls generally utilize the wider spacing between the attachment holes for seat and cover assemblies than those of American manufacturers it is not generally possible to use such standard American assemblies as original equipment or replacement on foreign toilet bowls. It is, accordingly, the principal object of this invention to provide a novel and improved extension or conversion devide for adaption of standard relatively hinged toilet seat and cover assemblies for use with non-standard bowls.

In accordance with the present invention, I provide substantially rectangular clamp bars having transverse, rectangular recesses at the underside which fit over and interengage with the hinge leaf portions of relatively hinged toilet seat and cover assemblies and extend laterally outwardly thereof to be attached against the top of the bowl through sidewardly offset openings. The recesses clamped upon the hinge leaves may be grooved or serrated to enhance the gripping action.

A more particular object of this invention is to provide a clamp bar of the above nature wherein the means for attachment to the bowl comprises a longitudinally-extending channel for the reception of a bowl attachment screw having a head longitudinally adjustably captured therein, thereby being adjustable to attachment holes of various spacings.

Still another object of the invention is to provide a rectangular clamp bar of the character described which will be simple in construction, economical to manufacture, attractive in appearance, easy to install, and long-wearing in use.

Other objects, features and advantages of the invention will be apparent from the following description when read with reference to the accompanying drawings.

In the drawings, wherein like reference numerals denote corresponding parts throughout the several views.

Figure 1:
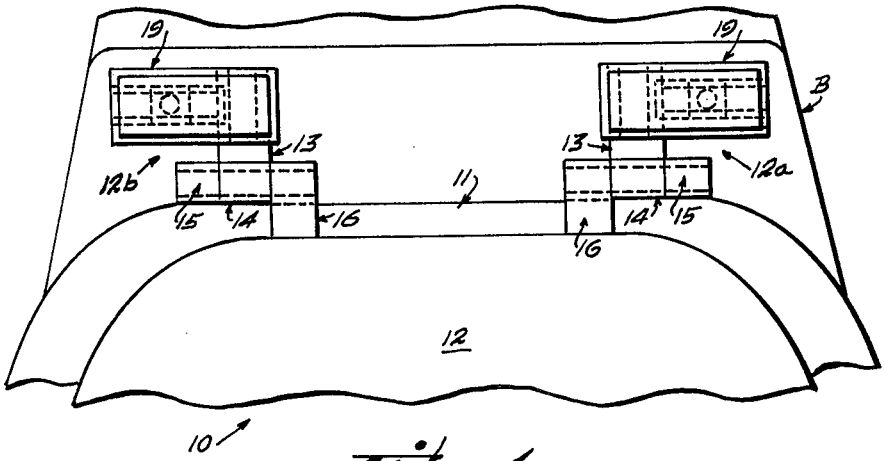
FIG. 1 is a fragmentary plan view of a toilet seat lid and bowl assembly the hinges of which are fitted with extension attachment devices embodying the invention for securement to the rear portion of a non-standard bowl.
Figure 2:
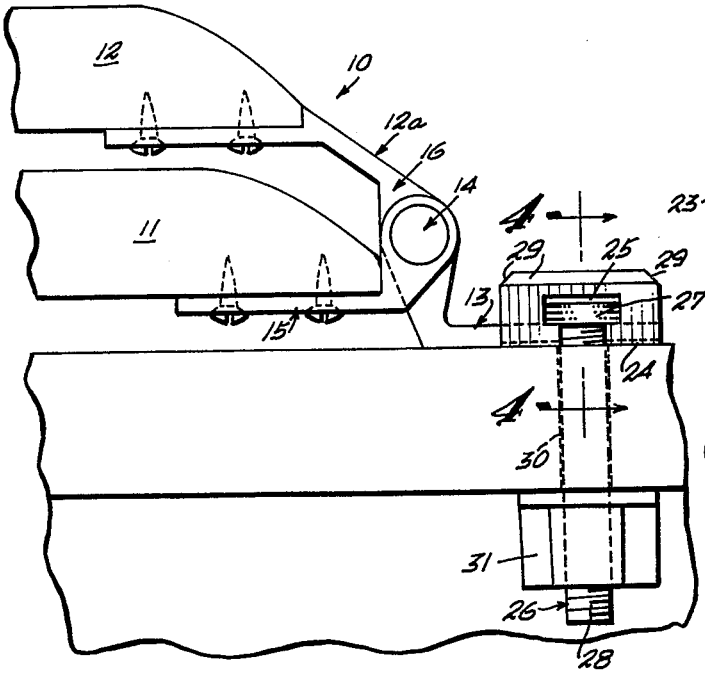
FIG. 2 is a fragmentary right-side elevation of the seat, lid and bowl assembly illustrated in FIG. 1.
Figure 3:
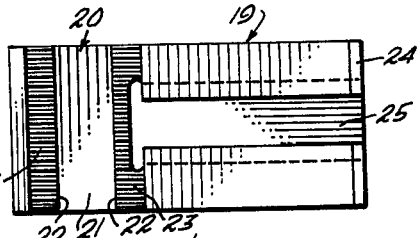
FIG. 3 is an enlarged bottom view of one of the extension attachment devices, shown separately.
Figure 4:
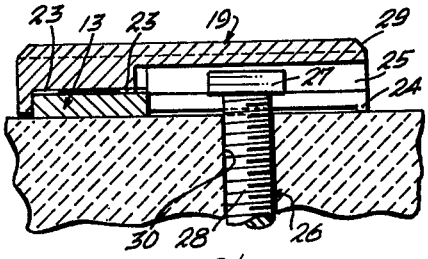
FIG. 4 is a vertical cross-sectional view taken through the section line 4—4 of FIG. 2 in the direction of the arrows.
Figure 5:
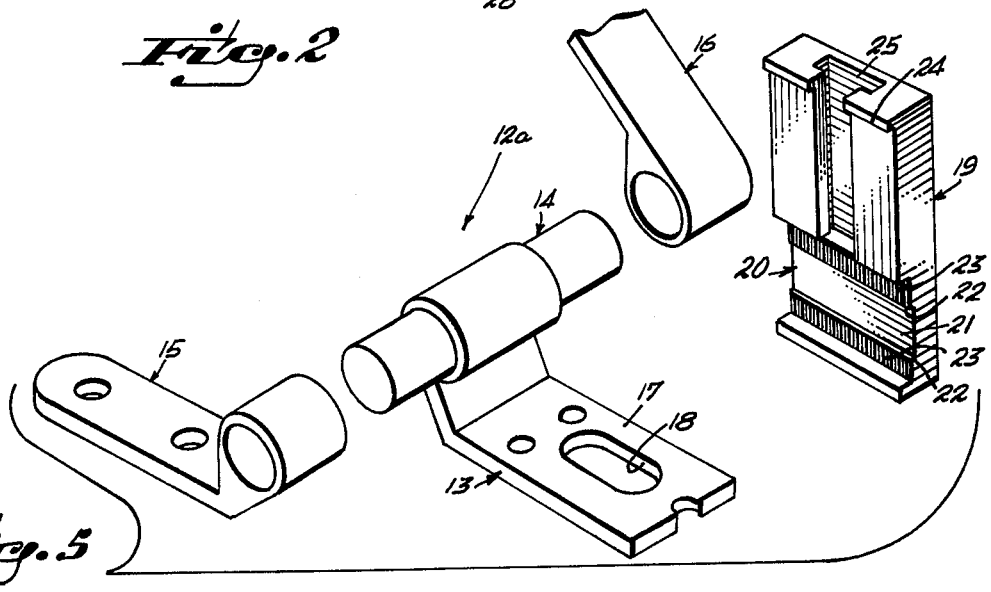
FIG. 5 is an exploded view, in perspective, of a hinge and extension attachment device embodying the invention.

Referring now in detail to the drawings, reference numeral 10 in FIGS. 1 and 2 designates, generally, a standard relatively-hinged toilet seat and cover assembly comprising a seat member 11 and a cover member 12 (partially illustrated) relatively hinged at rear portions thereof as by laterally-spaced hinges **12*a*, 12*b*. Since the hinges 12*a*, 12*b* form no part of the present invention and are not claimed herein, only so much thereof will be described as is necessary for an understanding of the lateral extension device for use in association therewith as is herein particularly claimed. As illustrated in FIGS. 1, 2 and 3, the hinge 12*a* comprises a bowl retention member 13 carrying a transverse pintle 14 extending outwardly of each side thereof to journal respective seat hinge leaf 15 and cover hinge leaf 16. The bowl retention member 13 comprises a flat, substantially-rectangular hinge leaf portion 17 adapted to seat flat against the top surface of a toilet bowl B at the rear of the bowl opening. The rectangular hinge leaf portion 17 is formed with an elongated, front-to-back opening 18 for through passage of a bowl attachment bolt extensible through vertical openings provided for this purpose in an ordinary standard toilet bowl of American manufacture. The elongated opening 18** provides for fore and aft adjustment of the toilet seat and lid assembly, as may be required to enable the seat and cover to turn up and beyond their respective hinge pins or pintles for resting abutment against the toilet bowl tank or other vertical structure behind the bowl opening.

Reference numeral 19 designates, generally, a rectangular clamp bar embodying the invention for adapting standard relatively-hinged toilet seat and cover assemblies 10 having rectangular hinge leaf portions 17 for use with nonstandard toilet bowls wherein the seat assembly attachment holes are spaced differently from such hinge spacing, usually being of a somewhat greater spacing. To this end, the rectangular clamp bar 19, which is generally elongated in shape, is formed in its underside near one end with a transverse slot 20, the width of which is slightly greater than the width of the rectangular hinge leaf portion 17 to which it is to be applied so as to fit in embracing relation thereupon and thereover, as illustrated in FIGS. 1 and 2 for example. The transverse slot 20 is provided with a central, end-to-end shallow recess 21 defining, along each side, slightly raised zones 22 which will preferably be serrated along their lengths, as indicated at 23. The opposite end of the rectangular clamp bar 19, at the underside thereo, is provided with a narrow, transverse, slightly outwardly-extending foot portion 24 which serves as a fulcrum in the clamping attachment of the rectangular clamp bar, as is hereinafter more particularly described.

Longitudinally adjustable means is provided for securing the clamp bar 19 in place with respect to the seat assembly attachment opening of a toilet seat bowl. To this end, the rectangular clamp bar 19 is provided, also in its underside, with a central, longitudinally-extending T-slot 25 which, as best illustrated in FIG. 3, is blind at its inner end, terminating a short distance within the inner serrations 23. Slidingly received within the T-slot 25 is a bolt 26, said bolt having a flat square head 27 of such size as to be slidingly captured within the enlarged opening portion of said T-slot so that the threaded shank portion 28 projects outwardly of the reduced width portion of said slot. As best illustrated in FIGS. 1 and 2, the upper peripheral edges of the rectangular clamp bar 19 are beveled, as indicated at 29, for aesthetic reasons.

In use, it will be understood that two of the rectangular clamp bars 19 embodying the invention will be required for each installation, one for each of the laterally-spaced hinges 12*a* and 12*b* of the standard relatively-hinged toilet seat and cover assembly 10 to be adapted for use with a non-conforming toilet bowls B, as illustrated by way of example in FIGS. 1 and 2. Assuming that the spacing between the bolt holes provided in the bowl B is somewhat greater than the spacing between the mounting hole openings 18 of the rectangular hinge leaf portions 17, a rectangular clamp bar 19 will be placed in interfitting, clamping relation over each of the rectangular hinge leaf portions 17 so as to project outwardly thereof in opposite directions. Upon tightening the nuts 31 on their respective bolts 26, the clamp bars 19 will be pulled forcefully down upon their respective hinge leaf portions 17 to clamp them in place against upper surface portions of the non-standard bowl B. In this connection, it is to be noted that the foot portion 24 at the outer end of each rectangular clamp bar 19 serves as a fulcrum about which said clamp bars can pivot as the opposite ends thereof are forced down in clamping engagement upon the respective hinge leaves 17. It is also to be noted that, in such clamping action, the fine teeth defined by the serrations 23 bite into upper surface portions of the hinge leaves 17 to retain them securely in place. The hinge leaves 17, moreover, are also adjustable fore and aft with respect to their relative clamped positions in the clamp bars 19 to be securely held in such adjusted position by the fine teeth of the serrations 23.

While I have illustrated and described herein only one form in which my invention can conveniently be embodied in practice, it is to be understood that this form is presented by way of example only and not in a limiting sense. The invention in brief, comprises all the embodiments and modifications coming within the scope and sphere of the following claims:

What I claim as new and desire to secure by Letters Patent is:

1. A clamping device for adapting standard, relatively-hinged toilet seat and cover assemblies for use with non-standard bowls, said assemblies having flat, spaced, parallel, rectangularly-shaped bowl securements hinge leaf portions for seating flat against the top surface of the toilet bowl at the rear of the bowl opening, comprising, in combination, an elongated rectangular clamp bar member having a flat undersurface, a transverse, rectangular recess in the underside of said clamp bar member near one end thereof, said clamp bar recess being of such rectangular shape as to embracingly receive said hinge leaf portion from underneath, a longitudinally-extending, central recess in said underside of said clamp bar member open to the other end thereof and terminating short of said one end thereof, said longitudinally-extending recess being of uniform cross-sectional shape and internally undercut to provide an internally-recessed portion of increased transverse size, and a threaded bolt having a head portion at one end received in said internally-recessed portion of increased size so as to be constrained to longitudinal movement therein and therealong, and a shank portion extending outwardly of said longitudinally-extending portion, said underside of said clamp bar member being provided at said other end thereof with a transversely-extending projection serving as a fulcrum in the clamping attachment of the clamp bar member to a toilet bowl.

2. A clamping device as defined in claim 1, wherein a bottom portion of said rectangular recess is serrated to provide a plurality of teeth for frictional interengagement with top surface portions of said hinge leaf portion.

3. A clamping device as defined in claim 2, wherein said longitudinally-extending recess is of T-shape cross-sectional configuration.

4. A clamping device as defined in claim 3, wherein said head portion of said bolt is rectangular in peripheral shape.

5. A clamping device as defined in claim 1, wherein said bottom portion of said rectangular recess is provided with a central, end-to-end recess defining slightly raised zones along each side thereof, said raised zones being transversely serrated to provide pluralities of transversely-extending teeth for frictional interengagement with top surface portions of said hinge leaf.

6. A clamping device as defined in claim 5, wherein said longitudinally-extending recess is of T-shape cross-sectional configuration.

7. A clamping device as defined in claim 6, wherein said head portion of said bolt is of rectangular peripheral shape.

* * * * *